US006270542B1

(12) United States Patent
Naylor

(10) Patent No.: US 6,270,542 B1
(45) Date of Patent: Aug. 7, 2001

(54) HOME AND INDUSTRIAL HEATING FURNACE THAT PRODUCES FUEL GAS

(76) Inventor: Harry E. Naylor, 1141 Lincoln Ave., Charleroi, PA (US) 15022

( * ) Notice: Subject to any disclaimer, the term of this patent is extended or adjusted under 35 U.S.C. 154(b) by 0 days.

(21) Appl. No.: 09/419,492

(22) Filed: Oct. 15, 1999

(51) Int. Cl.[7] ..... C10B 1/00; C10G 9/04

(52) U.S. Cl. ..... 48/119; 202/158; 202/254; 202/258; 126/101

(58) Field of Search ..... 48/119; 202/158, 202/166, 254, 258; 203/29, DIG. 6; 126/101

(56) References Cited

U.S. PATENT DOCUMENTS 17,309 * 5/1857 Bruce ..... 201/2
204,016 * 5/1878 Fitch ..... 48/104
5,235,102 * 8/1993 Palmer et al. ..... 562/607
5,404,865 * 4/1995 Huls ..... 126/206
5,730,843 * 3/1998 Groten et al. ..... 202/158
6,023,943 * 2/2000 Wang et al. ..... 62/627

* cited by examiner

*Primary Examiner*—Marian C. Knode
*Assistant Examiner*—Frederick Varcoe
(74) *Attorney, Agent, or Firm*—Webb Ziesenheim Logsdon Orkin & Hanson, P.C.

(57) ABSTRACT

A heating furnace for home and industrial use, having the ability to catalyze fuel oil to produce fuel gas for external applications. The heat produced can be radiated, or can be circulated by a heated air or heated water system.

14 Claims, 3 Drawing Sheets

HOME AND INDUSTRIAL HEATING FURNACE THAT PRODUCES FUEL GAS

BACKGROUND OF THE INVENTION

1. Field of the Invention

This invention relates to a heating furnace for home and industrial use that is capable of using a variety of liquid fuels and converting them catalytically to gaseous fuels that can be fed to other heating devices or to combustion engines. The heat produced can be circulated through heated air or heated water systems.

2. Description of the Related Art

Furnace technology making use of fuel oil is well-known and widely used. However, fuel oil is generally used in large-scale heating situations. Storage and supply constraints and the higher ignition temperature of fuel oil as compared to natural gas have limited its use in home heating in the United States to areas in the Northeast.

Because fuel oil is not as flexible in its applications as fuel gases, technologies have been developed to convert fuel oil to fuel gases. These technologies make use of catalysts to accomplish the necessary chemical reactions and distillation process to separate the resulting fuel gases from the fuel oils and, in some cases, to separate the fuel gases into components. However, catalytic conversion and distillation are normally carried out on an industrial scale. Heat is given off as a result of catalytic conversion and distillation processes; in industrial processes some of this heat can be recaptured to sustain the process, but much of it is wasted. A need exists for a device that will put this heat to use directly in small building and household applications.

For the production of quantities of fuel gases that can be used in a home or small building, a need exists to scale down and to integrate the catalytic conversion and distillation technologies.

SUMMARY OF THE INVENTION

In order to meet this need, the present invention is a heating furnace with integrated fuel catalysis capabilities. The furnace contains a boiler vessel, which is separated into a holding portion and a distillation portion. A burner for igniting the boiler vessel is located under the boiler vessel. The holding portion is supplied with a liquid fuel. Igniting the boiler vessel accomplishes two purposes. It begins a catalysis process, in which the liquid fuel is catalytically converted into compounds with lower boiling points, known as fuel gases. These gases are removed from the boiler vessel for use elsewhere in other heating devices or combustion engines. Secondly, the catalytic process produces heat which can be captured in a heat exchanger and transported through a heated air or heated water system.

The catalytic process produces coke deposits on the interior of the holding portion. These deposits can be removed periodically through combustion. The boiler vessel contains air vent holes, which are plugged during the catalytic process. For coke combustion, the burner is ignited, and the air vent holes are opened. Products of this combustion process escape through the boiler vent line, which is valved so that these combustion products do not mix with gaseous fuels produced in the catalytic process.

DETAILED DESCRIPTION OF THE PREFERRED EMBODIMENT

Figure 1:
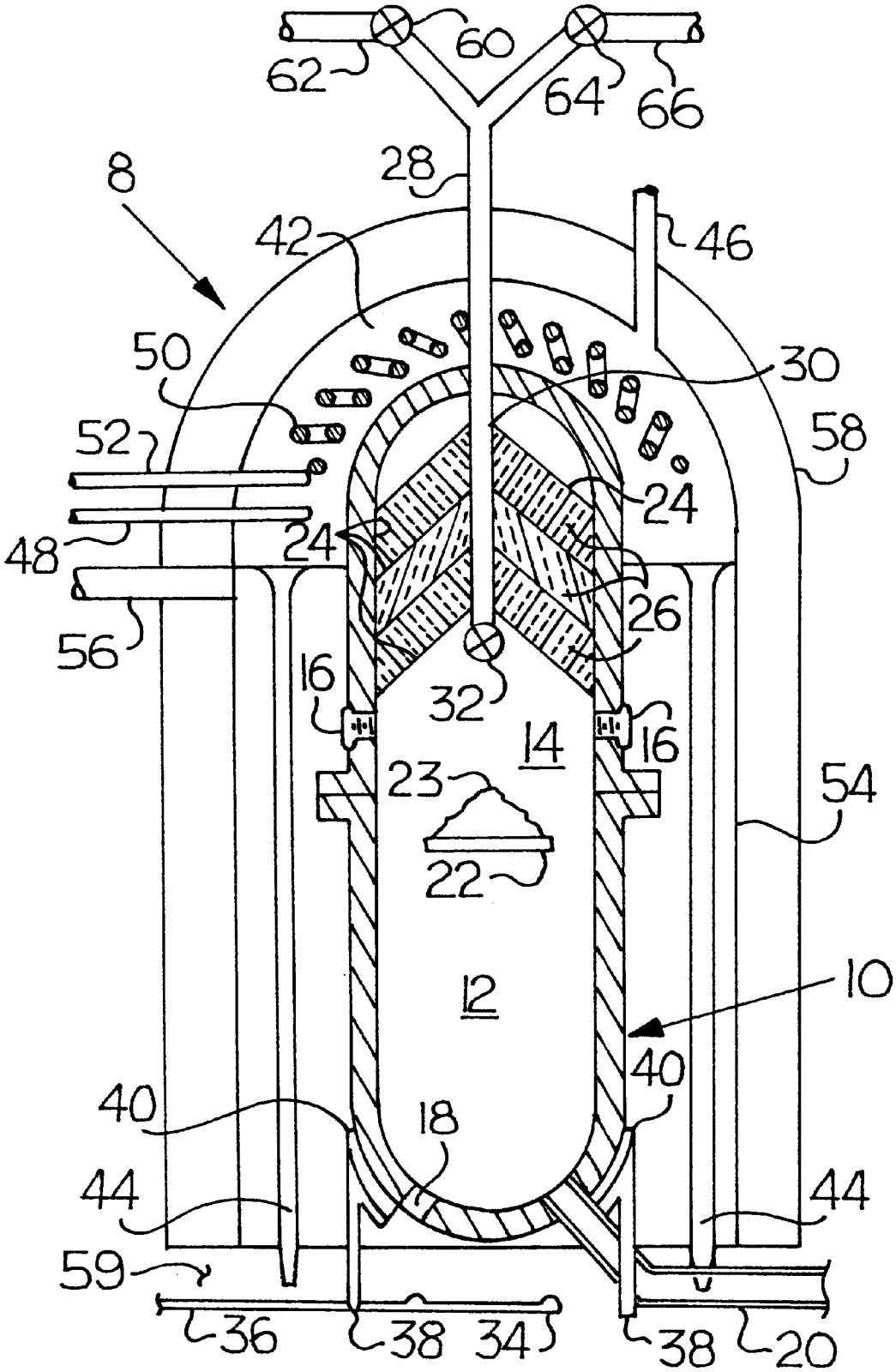
FIG. 1 is an elevation partially in section of a home and industrial heating furnace of the present invention.

As shown in FIG. 1, a home and industrial heating furnace 8 of the present invention integrates catalysis, distillation and heating capabilities into a single unit. It produces heat that can be circulated through a heated air or heated water circulation system as well as producing a mixture of gases that can be used for heating of a building, supplying a stove or running a combustion engine.

The furnace 8 contains a boiler vessel 10 which includes a holding portion 12 and a distillation portion 14. Holding portion 12 and distillation portion 14 may be attached to each other by any suitable means, such as by bolting together matching flanges. A plurality of plugs 16 is provided in the distillation portion 14 and can be removed to allow the introduction of air into the distillation portion 14 so that residues can be removed by combustion. Plugs 16 may be, for example, short bolts with pipe threads corresponding to pipe threads in openings in boiler vessel 10, and having tapered ends for pressure sealing. Optionally, a tapered gasket (not shown) can be placed over the tapered end of the bolt to produce a better seal. A plurality of drain plugs 18 is provided in the bottom of boiler vessel 10 which, when opened, allows residue to be cleaned out. A liquid fuel supply line 20 allows liquid fuel to be introduced into holding portion 12. A catalyst bed 22, located in the holding portion, serves as the site for the conversion of fuel oil to fuel gas. Catalyst 23 is located on catalyst bed 22. A plurality of distillation fins 24, as shown in FIGS. 1, 2B and 2C, secured to boiler vessel 10, located in distillation chamber 14, provides a surface on which fuel oil condenses more rapidly than does fuel gas. A plurality of fluid flow passages 25, preferably teardrop-shaped in cross-section, in the surfaces of distillation fins 24 directs condensed fuel oil downward and outward. An insulating material 26, for example, rock wool or a porous ceramic, is located between adjacent pairs of distillation fins 24. A boiler vent line 28 extends from the holding chamber 12 to the exterior of the boiler. Boiler vent line 28 is separated from the distillation fins 24 by a screen 30, and from the holding chamber 12 by a boiler vent line valve 32. Outside and below the boiler, a burner 34, fed by a gaseous fuel supply line 36, enables heat to be supplied to holding chamber 14. A stand 38, surmounted by a stop 40, supports boiler vessel 10 over burner 34. Stop 40 is of a size to provide the appropriate clearance between boiler vessel 10 and burner 34.

A heated air compartment 42 is in thermal communication with boiler vessel 10. The thermal communication permits the transfer of heat from a warmer object to a cooler object, in this case from boiler vessel 10 to heated air compartment 42. The heated air compartment 42 is in fluid isolation from the holding portion 12, and is in fluid isolation from the boiler vent line 28. Air to be heated is introduced to heated air compartment 42 through a plurality of air supply lines 44, and expelled through a heated air collection line 46. The heated air collection line 46 is in fluid isolation from the holding portion 12, and is in fluid isolation from the boiler vent line 28. The air supply line 44 is in fluid isolation from the holding portion 12, and is in fluid isolation from the boiler vent line 28. Optionally, heat can be transferred from the boiler vessel 10 to a heated water network. This is accomplished by the introduction of water, through a water supply line 48, to a water coil 50, which is in thermal communication with boiler vessel 10. Heated water is withdrawn through a heated water collection line 52. The heated fluid produced., whether heated air or heated water, can be used for room or building heating.

Boiler vessel 10 is surrounded by a jacket 54, which optionally may form part of the exterior of heated air compartment 42. Jacket 54 can be constructed of any suitable material, for example, sheet metal. A burner vent line 56 allows the volume outside boiler vessel 10 enclosed by jacket 54 and, hence, burner 34, to be vented. Burner vent line 56 is in fluid isolation from heated air collection line 46. If the furnace is to be used for heating a room directly, an external jacket 58, surrounding jacket 54, may also be used. A clearance space 59 around the bottom of jacket 54, preferably with a clearance of approximately four inches, allows fresh air to reach burner 34. The lower end of air supply line 44 is configured to receive fresh air through clearance space 59.

Figure 2A:
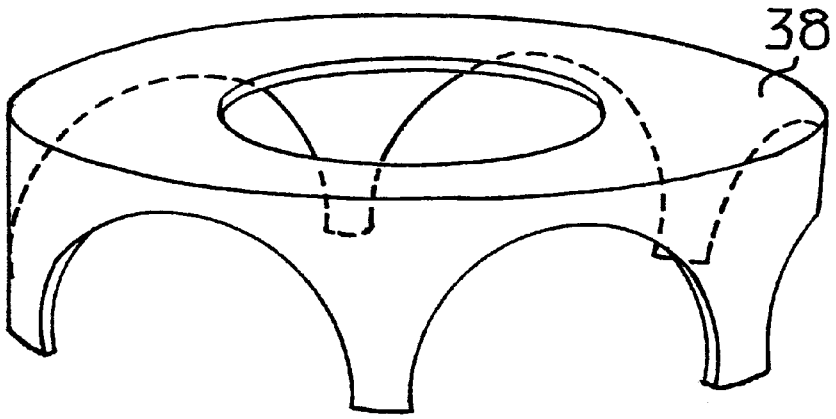
FIG. 2A is a top perspective view of a boiler stand made in accordance with the present invention.
Figure 2B:
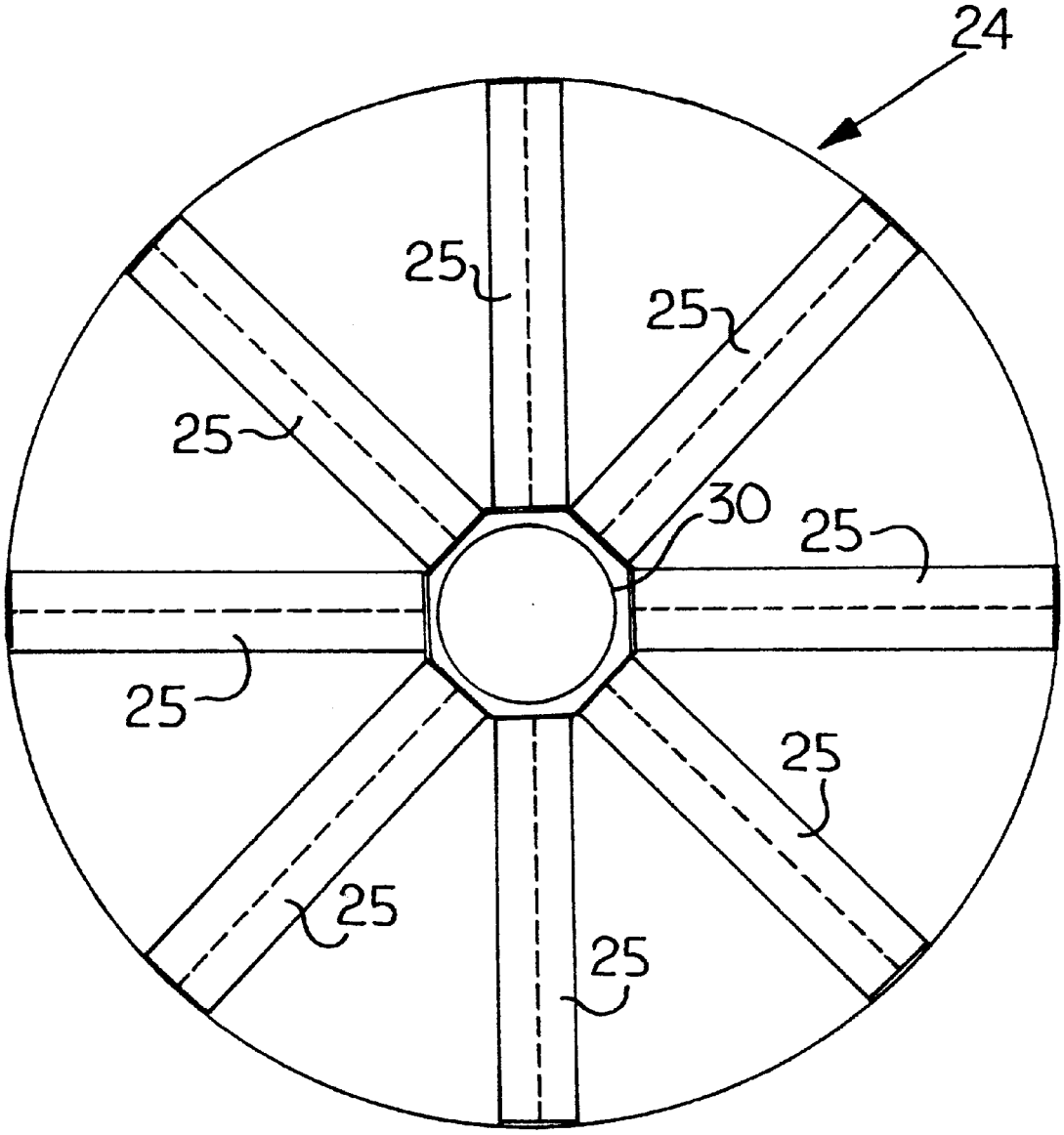
FIG. 2B is a top plan view of a fin made in accordance with the present invention having a plurality of teardrop shaped passageways.
Figure 2C:
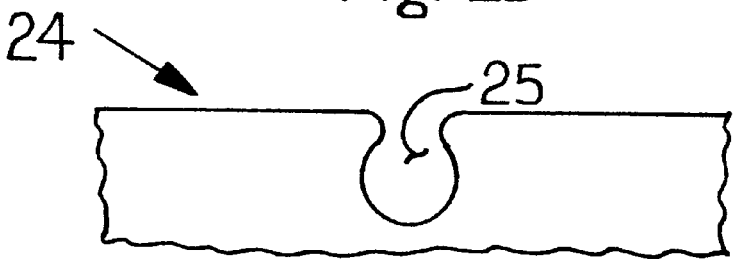
FIG. 2C is an elevation of a portion of the fin shown in 2B.

Preferably, as shown in FIG. 2A, stand 38 has five legs and five openings, as shown in FIG. 2, allowing access to the bottom of boiler vessel 10. Each opening allows access to a drain 18 or to liquid fuel supply line 20.

In the operation of the furnace, oil enters holding chamber 12 through liquid fuel supply line 20. Plugs 16 are closed. Boiler vent line valve 32 is closed. Burner 34 is ignited. The oil vaporizes and comes in contact with catalyst 23 on catalyst bed 22, where a portion of it is converted to fuel gas. The catalyst may be any suitable catalyst, for example, aluminum silica catalyst. Vaporized oil and fuel gas flow into distillation chamber 14 and through insulating material 26, typically rock wool or porous ceramic, housed between adjacent pairs of distillation fins 24. Insulating material 26 produces a temperature differential within the distillation chamber. When the vaporized oil comes in contact with distillation fins 24, it condenses. Passages 25 in distillation fins 24 conduct the condensed oil downward and outward. The fuel gas remains in the gaseous state and flows from the boiler through screen 30 into boiler vent line 28. Boiler vent line 28 leads to a coke flue valve 60, through which a coke flue 62 is reached, and a product collection line valve 64, through which a product collection line 66 is reached. In the furnace operating mode, coke flue valve 60 is closed and product collection line valve 64 is opened, so that fuel gas flows through into product collection line 66 for direct use or for storage. Furnace operation thus results in the simultaneous production of fuel gas and heat.

A typical operating temperature of the unit is 1750° F. Pressure inside the boiler in operation is typically in the range from 150 pounds per square inch to 600 pounds per square inch. The cracking temperature is typically in the range of 1000° F. to 1100° F.

Coke, a solid hydrocarbon residue, is generated in the catalytic process and must be removed from the catalyst occasionally for the furnace to function efficiently. The coke is removed through combustion. In the removal process, plugs 16 are opened, allowing air into the boiler. Burner 34 is ignited. Boiler vent line valve 32 is opened. A coke flue valve 60, located outside boiler vessel 10 on boiler vent line 28, is opened, allowing gases produced by the coke to escape through a coke flue 62 to the atmosphere. A production collection line valve 64, also located outside boiler vessel 10 on boiler vent line 28, is closed, so that gases produced by the coke do not enter a product collection line 66.

Figure 3:
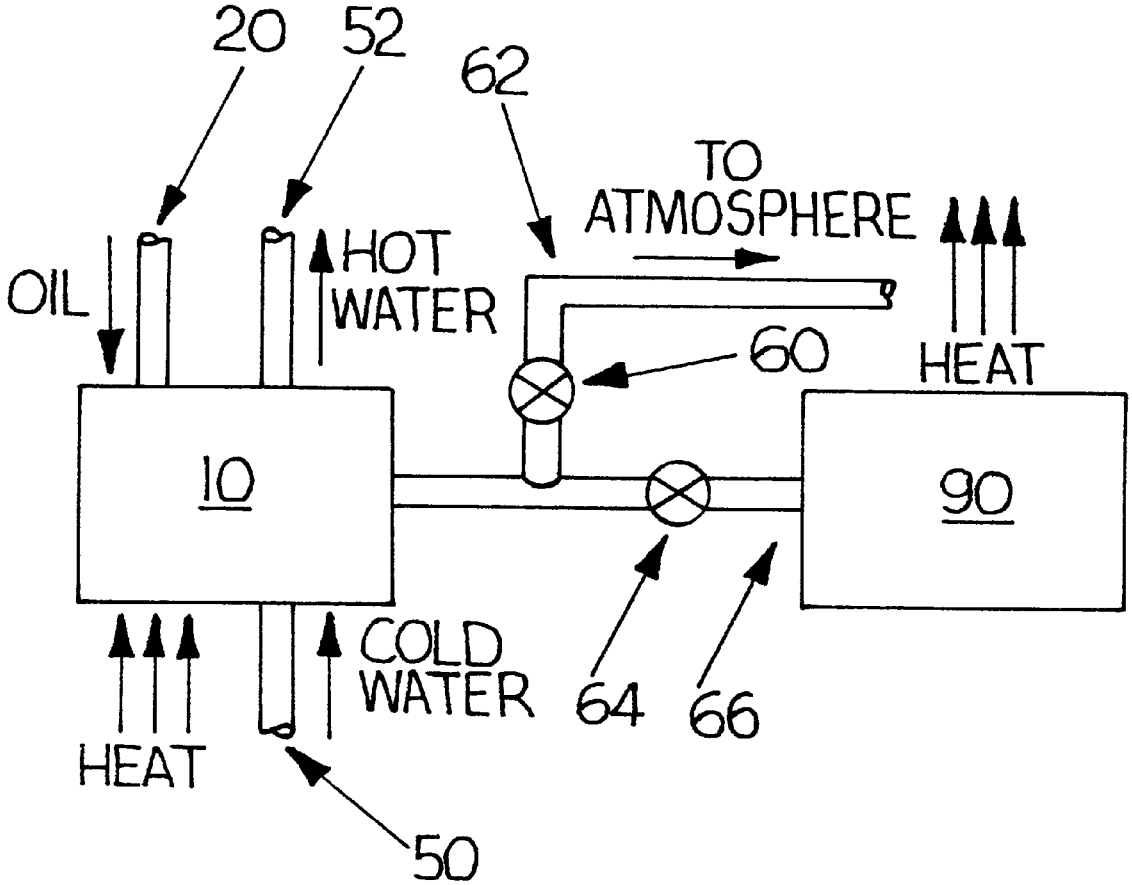
FIG. 3 is a block diagram depicting the relationship of the components of the home and industrial heating furnace of the present invention.

FIG. 3 depicts the relationship of the components of the home and industrial heating furnace of the present invention. Liquid fuel is introduced to boiler vessel 10 through liquid fuel supply line 20. Its conversion to fuel gas heats water introduced through water supply line 50 and withdrawn through heated water collection line 52. The fuel gas produced passes through product collection line 66 into an auxiliary heater 90, where it is ignited for the production of heated air or water.

Having described the currently preferred embodiment of the present invention, it is to be understood that the invention may be otherwise embodied within the scope of the appended claims.

I claim:

1. A heating furnace, comprising:

a boiler vessel, the boiler vessel containing a holding portion, and a distillation portion in communication with the holding portion, the boiler vessel defining a plurality of holes passing therethrough;

a liquid fuel supply line, in fluid communication with the holding portion;

a catalyst bed, for supporting catalyst, located within the holding portion;

distillation fins, located within the distillation portion, a boiler vent line, partially located within and extending from the distillation portion;

a boiler vent line valve, in fluid communication with the boiler vent line;

a collection line, in fluid communication with the boiler vent line valve, a burner, located below the holding portion;

a gaseous fuel supply line, in fluid communication with the burner;

a plurality of plugs sealing the holes defined by the boiler vessel;

a heated air compartment, in thermal communication with and exterior to the boiler vessel, in fluid isolation from the holding portion, and in fluid isolation from the boiler vent line;

an air supply line, in fluid communication with the heated air compartment in fluid isolation from the holding portion, and in fluid isolation from the boiler vent line;

a heated air collection line for the withdrawal of heat from the beating furnace, in fluid communication with the heated air compartment, in fluid isolation from the holding portion, and in fluid isolation from the boiler vent line, a jacket, having an interior and an exterior, surrounding the boiler vessel; and a burner vent line, wherein a space is defined between the jacket and boiler vessel, wherein the burner vent line is in fluid communication with the space defined between the jack and the boiler vessel, and wherein the burner vent line is isolated from the heated air collection line.

2. The heating furnace according to claim 1, further comprising a screen positioned within the distillation portion and located between the distillation fins and the boiler vent line.

3. The heating furnace according to claim 1, further comprising insulating material positioned between the distillation fins.

4. The heating furnace according to claim 1, wherein the boiler vessel is spaced from the burner.

5. The heating furnace according to claim 1, wherein the boiler vessel has a plurality of drains passing therethrough, further comprising a plurality of drain plugs sealing the drains.

6. The heating furnace according to claim 1, further comprising:

a stand, positioned below the boiler vessel; and a stop, providing the desired clearance between the stand and the boiler vessel, positioned between the stand and the boiler vessel.

7. The heating furnace according to claim 1, further comprising:

a water coil, in thermal communication with the boiler vessel;

a water supply line, in fluid communication with the water coil; and a heated water collection line, in fluid communication with the water coil.

8. The heating furnace according to claim 1, in which the jacket is constructed from sheet metal.

9. The heating furnace according to claim 1, further comprising:

a coke flue valve, in fluid communication with the boiler vent line;

a coke flue, in fluid communication with the coke flue valve;

a product collection line valve, in fluid communication with the boiler vent line; and a product collection line, in fluid communication with the boiler vent line, wherein a first position of the coke flue valve and the product collection line valve permits fuel gas production, and wherein a second position of the coke flue valve and the product collection line valve allows coke combustion to proceed.

10. The heating furnace according to claim 9, further comprising an auxiliary heater in fluid communication with the product collection line.

11. The heating furnace according to claim 1, further comprising an external jacket surrounding the jacket.

12. The heating furnace according to claim 1, wherein at least one of said distillation fins includes a frusto-conical shaped body having fluid flow passages defined thereto.

13. The heating furnace according to claim 12, wherein the flow passages are teardrop shaped.

14. The heating furnace according to claim 1, wherein catalyst is housed on the catalyst bed.

* * * * *

UNITED STATES PATENT AND TRADEMARK OFFICE

CERTIFICATE OF CORRECTION

PATENT NO. : 6,270,542 B1
DATED : August 7, 2001
INVENTOR(S) : Harry E. Naylor

It is certified that error appears in the above-identified patent and that said Letters Patent is hereby corrected as shown below:

Column 3,
Line 9, "produced.," should read -- produced, --.

Column 4, claim 1,
Line 48, "beating furnace" should read -- heating furnace --.

Signed and Sealed this

Twenty-sixth Day of February, 2002

*Attest:*

*Attesting Officer*

JAMES E. ROGAN
*Director of the United States Patent and Trademark Office*